United States Patent [19]

Schiesz et al.

[11] Patent Number: 4,649,690

[45] Date of Patent: Mar. 17, 1987

[54] APPARATUS FOR APPLYING CARRIERS ONTO CONTAINERS

[75] Inventors: Louis B. Schiesz, 1222 E. Kessler Blvd., Indianapolis, Ind. 46220; Patrice A. Kroczynski, Santa Monica, Calif.

[73] Assignee: Louis B. Schiesz, Indianapolis, Ind.

[21] Appl. No.: 876,779

[22] Filed: Jun. 20, 1986

[51] Int. Cl.[4] ..... B65B 27/04; B65B 67/00

[52] U.S. Cl. ..... 53/48; 53/390; 53/556

[58] Field of Search ..... 53/48, 390, 556, 398, 53/441

[56] References Cited

U.S. PATENT DOCUMENTS

| | | | |
|---|---|---|---|
| 2,929,181 | 3/1960 | Poupitch | 53/48 X |
| 3,032,944 | 5/1962 | Hull et al. . | |
| 3,156,971 | 11/1964 | DeShazor, Jr. | 53/48 X |
| 3,221,470 | 12/1965 | Stevenson, Jr. | 53/48 |
| 3,383,828 | 5/1968 | Cunningham . | |
| 3,404,505 | 10/1968 | Hohl et al. . | |
| 3,541,751 | 11/1970 | Quebe et al. | 53/48 X |
| 3,628,305 | 12/1971 | Owen et al. . | |
| 3,742,677 | 7/1973 | Best . | |
| 3,816,968 | 6/1974 | Morgan et al. . | |
| 3,959,949 | 6/1976 | Benno et al. . | |
| 4,169,343 | 10/1979 | McArdle . | |
| 4,240,239 | 12/1980 | Stelzner et al. . | |
| 4,250,682 | 2/1981 | Braun . | |
| 4,324,085 | 4/1982 | Olsen . | |
| 4,354,333 | 10/1982 | McArdle . | |
| 4,354,334 | 10/1982 | Hara . | |
| 4,392,337 | 7/1983 | Hara . | |

*Primary Examiner*—Horace M. Culver

*Attorney, Agent, or Firm*—Barnes & Thornburg

[57] ABSTRACT

An apparatus for applying a carrier member onto the lip of a container is provided. The apparatus includes a stationary base unit and first stretcher elements fixed to the base unit for engaging one of the pair of openings of the carrier member by its inner peripheral edge. The apparatus also includes second stretcher elements that are movable with respect to the base unit from an inner position to an outer position for engaging the other of the pair of openings of the carrier member by its inner peripheral edge. The apparatus further includes a single enlongated handle and a pair of interacting lever arms that cooperate to move the second stretcher elements from the inner position to the outer position to stretch the pair of openings a distance sufficient to allow each of the pair of openings to receive the lip of the container. The apparatus further includes a lifting plate for elevating the assembled carrier member and containers in a direction generally perpendicular to the plane of the base unit.

13 Claims, 7 Drawing Figures

APPARATUS FOR APPLYING CARRIERS ONTO CONTAINERS

The present invention relates to an apparatus for attaching container carriers onto containers. More particularly, the present invention relates to an apparatus for applying a carrier formed from a flat sheet of stretchable material that includes openings that are sized to capture the peripheral edges of a specified number of containers, such as beverage cans. The assembled carrier and cans form a unit commonly referred to as a six-pack.

In conventional beverage cans, at least one end of the can includes a peripheral edge that extends circumferentially around the end. Conventional carriers are commonly formed from a sheet of stretchable material, for example plastic, that is formed to include a number of openings sized slightly smaller than the diameter of the peripheral can edges in its unstretched condition. The carrier is capable of being stretched to allow the cans to be inserted into the enlarged openings. When the stretching force is released, the carriers are designed to return to their normal, unstretched condition to capture the peripheral edges of each inserted can. Normally, the carrier sheet will have six openings, generally arranged in two rows of three, with six cans captured to form an assembled six-pack. This assembled six-pack forms a package that is much more convenient to transport by the purchaser. Such assembled packages of beverage cans are more desirable than a like number of unassembled loose cans, and therefore the assembled package commands a somewhat higher selling price.

Devices capable of applying stretchable carriers onto a number of beverage cans are known. Generally, these devices are intended for use by beverage producers, and are designed to assemble a large number of carriers and beverage cans in an assembly line-like manner. Because of the size and cost of these devices, they are not adaptable to the smaller operator, such as, for example liquor stores, convenience stores, and gas stations. Such small operators require a unit that is both small in size, and economical to purchase and operate.

A portable apparatus for applying carriers onto containers is disclosed in U.S. Pat. No. 3,628,305 issued Dec. 21, 1971 to Owen. U.S. Pat. No. 3,628,305 discloses a device that is used to stretch a carrier strip having six openings to permit the introduction of six cans into the openings. The device then releases the stretching force and the assembled cans and carrier strip may then be lifted off of the unit. The device utilizes spaced apart, upright stretcher pins that enter each opening of the carrier strip. The stretcher pins are mounted on slide bars that are configured to move in opposite directions to stretch the carrier strip and openings a distance sufficient to allow individual cans to be inserted into each opening. After the cans are inserted into the stretched openings, the stretching pressure is released and the assembled carrier strip and cans must be physically pulled off of the stretcher pins to disengage the stretcher pins from the carrier strip. The stretching force is applied to the stretcher pins and slide bars by two oppositely positioned moveable handles that act as levers to apply force in opposite directions to the slide bars.

One problem with the device disclosed in U.S. Pat. No. 3,628,305 is that two levers must be activated to perform the stretching motion. Thus, the operator must utilize two hands simultaneously to conduct the stretching.

Another problem with the device disclosed in U.S. Pat. No. 3,628,305 is that the use of two, small diameter, stretcher pins in each opening to stretch the carrier strip may cause the carrier strip to be deformed in the area around the stretcher pins. This may occur because the small diameter stretcher pins are applying a great deal of force to a relatively small area of the carrier strip. This may cause the area of the carrier strip around each stretcher pin to be deformed beyond the point where it is able to recover to its original condition.

Another problem with the device disclosed in U.S. Pat. No. 3,628,305 is that the assembled carrier strip and beverage cans must be physically pulled upwardly to disengage the stretcher pins from the carrier strip.

One object of the present invention is to provide a portable apparatus for applying carriers onto containers that is capable of being operated by one handle or lever.

Another object of the present invention is to provide an apparatus for applying carriers onto containers in which the openings in the carrier strip are stretched by stretching members in a manner that prevents any deformation of the carrier strip itself.

Yet another object of the present invention is to provide an apparatus for applying carriers onto containers in which the assembled carrier and containers are mechanically lifted upwardly away from the stretcher elements.

According to the present invention, an apparatus for applying a carrier member formed from a sheet of stretchable material having at least a pair of opposed openings, each sized to engage the lip of a container when stretched a predetermined distance is provided. The apparatus includes a stationary base unit and first means fixed to the base unit for engaging the inner peripheral edge of one of the pair of openings. The apparatus also includes second means that are moveable with respect to the base unit from an inner position to an outer position for engaging the inner peripheral edge of the other pair of openings, and means for moving the second engaging means from the inner position to the outer position to displace the second engaging means away from the first engaging means to stretch the pair of openings a distance sufficient to allow each of the pair of openings to receive the lip of the container, with the movement of the second engaging means defining a working plane. The apparatus further includes means for releasing the second engaging means from the outer position to permit each of the pair of openings to engage and capture the lip of the received container and means for elevating the assembled carrier member and containers in a directional orthogonal to the working plane.

One feature of the foregoing structure is that only the second engaging means is moveable within the base unit. One advantage of this feature is that only a single moving means is required to effect the stretching operation. This allows the device according to the present invention to be much simpler in construction, and also requires the operator to use only one hand to activate the device. This feature also allows the device to be used in a much more confined space than the known units.

Another feature of the foregoing structure is that an elevating means is provided to lift the assembled carrier member and containers away from the base unit and engaging means after the assembly procedure is completed. One advantage of this feature is that the assembled carrier member and containers are thereby placed in a position where they may be easily moved by the operator to a storage location. Another advantage of this feature is that the elevating means allows the peripheral edges of the carrier member to be disengaged from the first and second engaging means in a precise manner designed to maintain the integrity of the carrier member and to prevent any possible disassembly of the assembled carrier member and containers in the removing process.

In preferred embodiments of the present invention, the moving means includes a pair of interacting lever arms that cooperate to move and lock the second engaging means in the outer position, and an enlongated handle that is pivotally mounted in the base unit and connected to one of the lever arms.

One feature of the foregoing structure is that a single enlongated handle is provided for the operator to actuate the stretching procedure of the device. One advantage of this feature is that the device can be operated with only one hand. This allows the second hand of the operator to be free to perform associated tasks, such as loading and placing the containers onto the device.

Also in preferred embodiments of the present invention, the elevating means includes a moveable plate and lifting means for moving the plate in a direction orthogonal to the working plane. The lifting means includes a spiral cam that is rotatably mounted in the base unit with a cam follower disposed within the spiral cam that is attached to the plate. The spiral cam is driven by the enlongated handle that also drives the second engaging means.

One feature of the foregoing structure is that the single enlongated handle performs all of the functions necessary for the operation of the device, including the stretching operation and the lifting operation. One advantage of this feature is that by utilizing a single handle to activate all operational modes of the device, the device is much simpler in construction and in operation.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
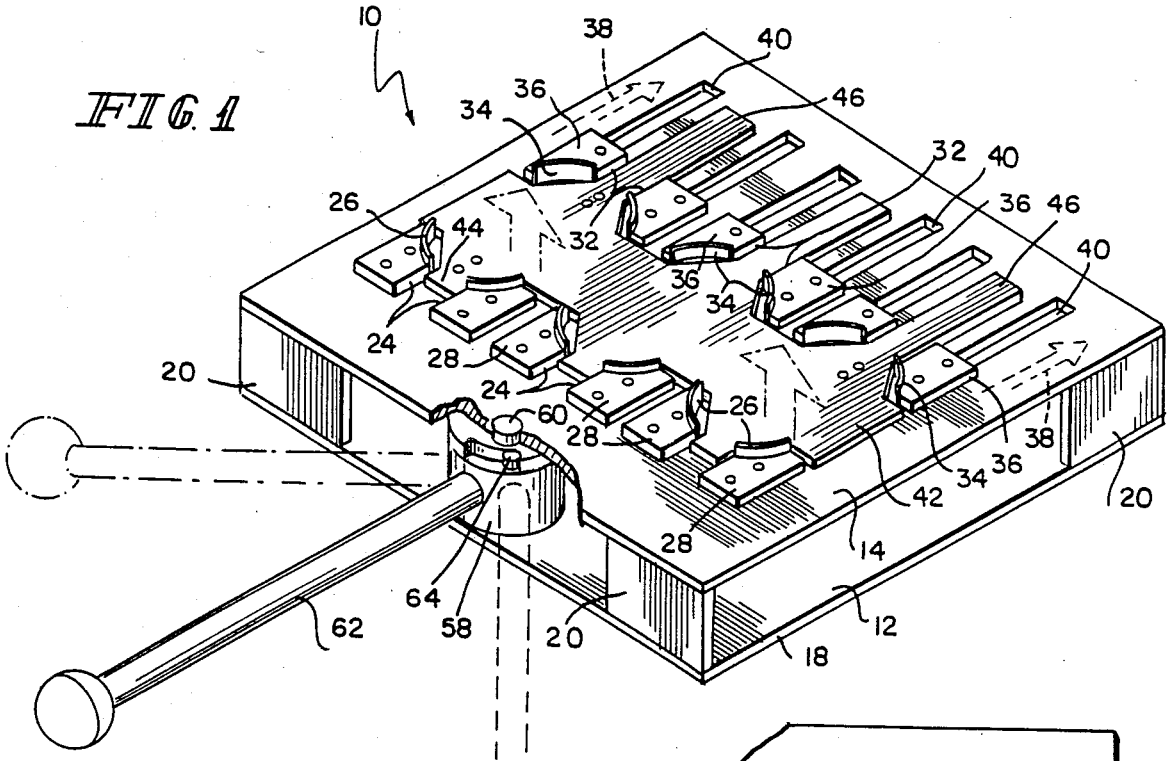
FIG. 1 is an isometric view of the apparatus.

Referring now to the drawings, and particularly to FIG. 1, an apparatus 10 for applying carriers onto containers is shown. The apparatus 10 includes a base unit 12 which includes an upper platform 14 and a lower platform 18. Four supporting legs 20 are rigidly attached to the corners of the lower platform 18 to support the upper platform 14 in a spaced apart, parallel relation. Illustratively, the upper platform 14 and the lower platform 18 are one-quarter inch (6.35 mm.) in thickness, and the upper platform 14 and the lower platform 18 are spaced apart 1.77 inches (45 mm.). Also illustratively, the upper platform 14 and lower platform 18 are square with each side being 9.45 inches (240 mm.) in length.

Figure 2:
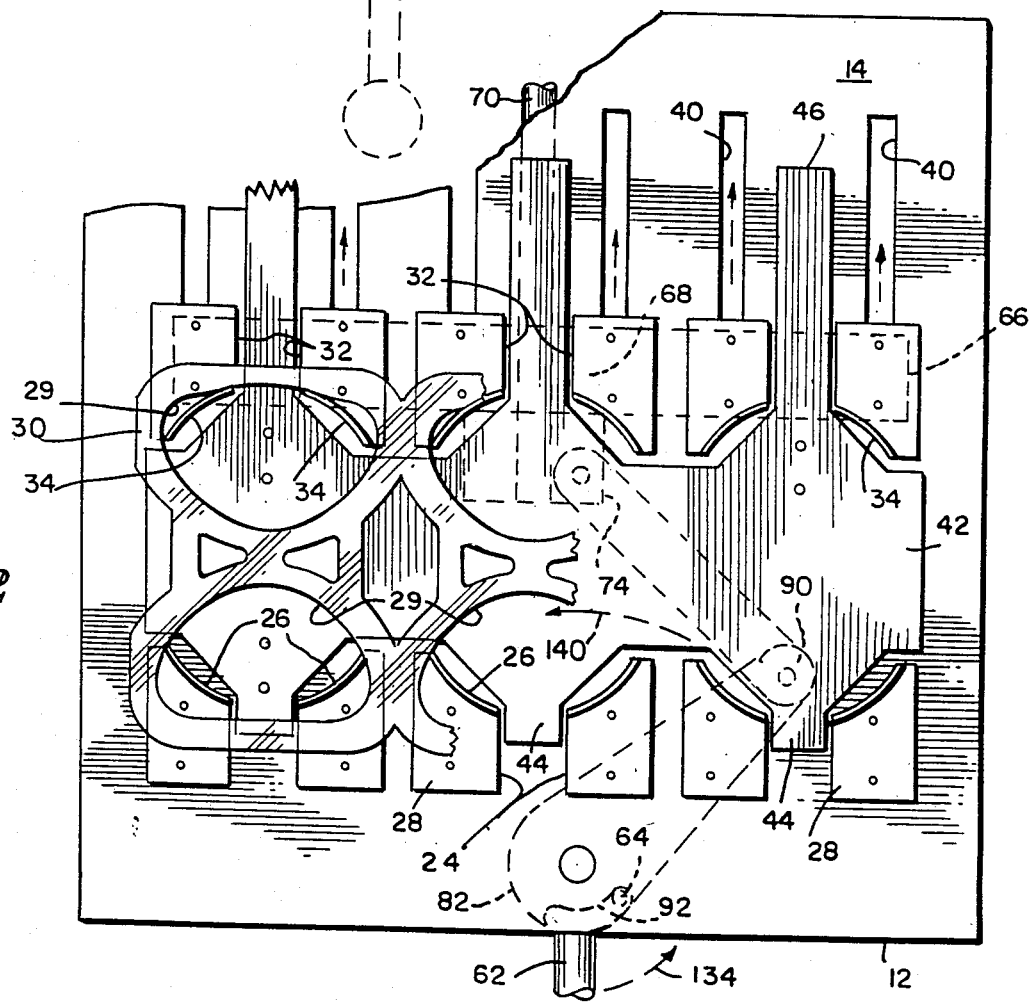
FIG. 2 is a top plan view with portions broken away of the apparatus with the second engaging means shown in the carr,ier member loading position.

Three pair of first stretcher elements 24 are firmly attached to the upper platform 14. Each pair of first stretcher elements 24 includes two arcuate shaped metal clips 26, each clip mounted on first clip retainers 28, with each clip retainer 28 rigidly attached to the upper platform 14. The arcuate shaped clips 26 are configured to engage the inner peripheral edge 29 of the openings in a carrier member 30, as shown in FIG. 2.

Referring again to FIG. 1, three pair of second stretcher elements 32 are shown slideably mounted on the upper platform 14. Each pair of second stretcher elements 32 includes two arcuate shaped clips 34, identical to clips 26, and two second clip retainers 36. Like the arcuate shaped clips 26, the arcuate shaped clips 34 are configured to engage the inner peripheral edge 29 of the openings in carrier member 30. The second stretcher elements 32 are jointly slideable from an inner position, shown in FIG. 1, toward an outer position as indicated by arrows 38 in FIG. 1. The second clip retainers 36 are configured to slide in slots 40 that are formed in the upper platform 14.

A lifting plate 42 is movably mounted onto the upper platform 14. The lifting plate 42 is a generally rectangularly shaped plate disposed between the first stretcher elements 24 and the second stretcher elements 32. The lifting plate 42 includes outwardly extending fingers 44 that extend between each pair of first clip retainers 28 a distance sufficient to extend beyond an arc described by the arcuate shaped clips 26. The lifting plate 42 further includes second outwardly extending fingers 46 that extend between each pair of second clip retainers 36 a distance sufficient to extend beyond an arc described by the clips 34, even when the second stretcher elements 32 are in the outer position. The lifting plate 42 is movable from a retracted position, shown in FIG. 1, outwardly away from the upper platform 14, to an extended position as indicated by the arrows 50.

A hub member 58 is rotatably mounted between the upper platform 14 and the lower platform 18. The hub member 58 includes outwardly extending journals 60 (only one of which is shown in FIG. 1) that extend into the upper platform 14 and the lower platform 18 to permit the hub member 58 to rotate. An enlongated handle 62 is rigidly attached to the hub member 58 to permit an operator to easily rotate the hub member 58. A drive pin 64 extends outwardly from the upper surface of the hub member 58, the use of which will be discussed later.

Figure 5:
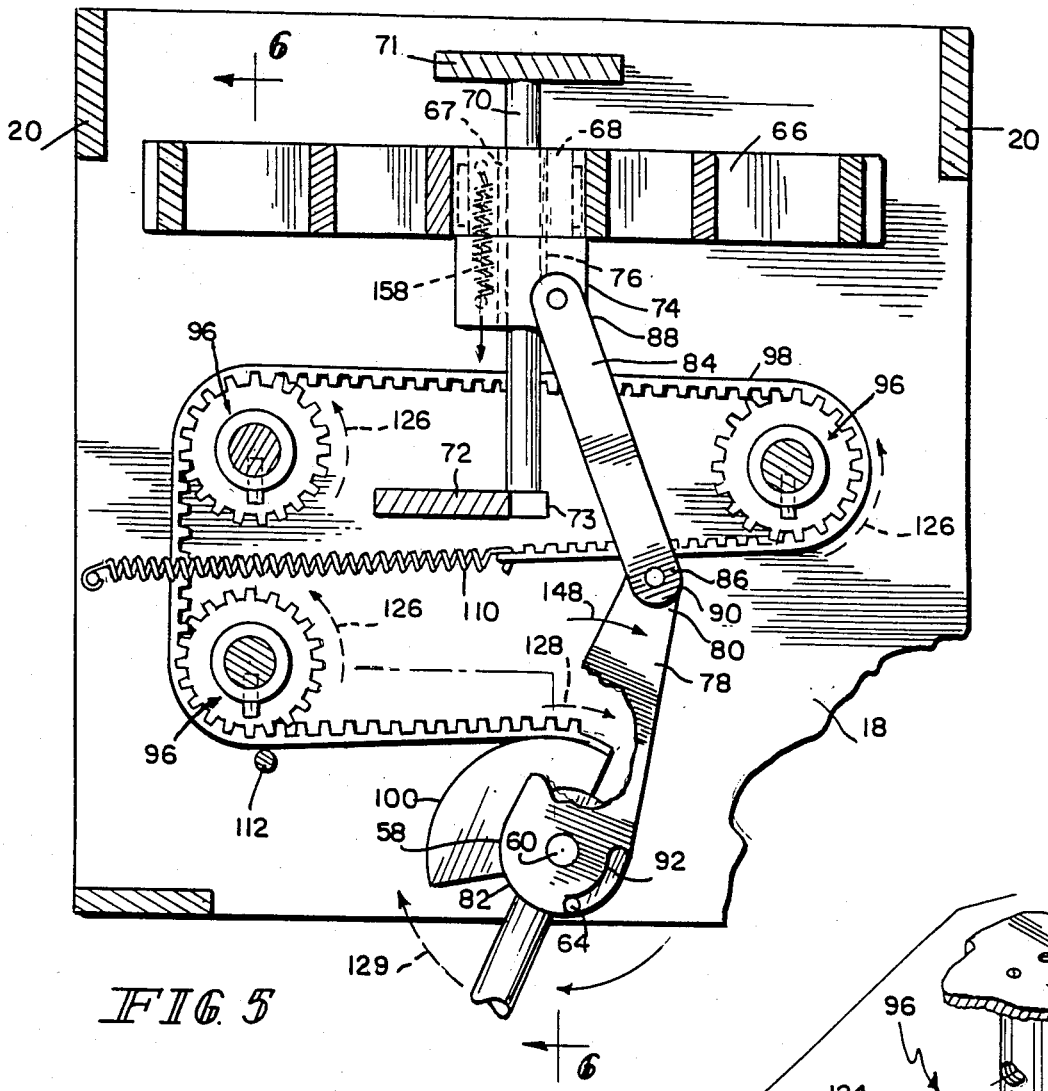
FIG. 5 is a sectional view taken along lines 5—5 of FIG. 4.

Referring now to FIG. 5, FIG. 5 shows in more detail the mechanisms for moving the second stretcher elements 32 from the inner position to the outer position to stretch the carrier member 30, and for lifting the lifting plate 42 from the retracted position to the extended position. A transverse bar 66 is shown transversely mounted between the upper platform 14 and the lower platform 18. The second clip retainers 36 are rigidly attached to the transverse bar 66 through the slots 40. A slide block 68 (shown in dotted) is mounted on the underneath side of the transverse bar 66 near its center. The slide block 68 includes a central aperture and a bearing 69 (shown only in dotted) and is adapted to slidingly move on a slide shaft 70. The slide shaft 70 is supported on, and extends between, an outer support 71 and an outwardly extending step portion 73 of an inner support 72. The outer support 71 and the inner support 72 extend between, and are attached to the lower platform 18 and the upper platform 14, in a manner similar to the supporting legs 20.

A drive block 74 is also slidingly mounted on the slide shaft 70. The drive block 74 includes a central aperture having a bearing 76 (shown only in dotted) to permit the drive block 74 to slide on the slide shaft 70. The drive block 74 is moved on the slide shaft 70 by a lever arm assembly that includes a drive lever arm 78 having a first end 80 and a second end 82, and a pair of parallel, spaced apart connecting lever arms 84 that jointly have a first end 86 and a second end 88. The second end 82 of the drive lever arm 78 is mounted on the upwardly extending journal 60 of the hub member 58 and is rotatable about that journal 60. The first end 80 of the drive lever arm 78 is pivotally connected with the first end 86 of the connecting lever arms 84, to form a lever joint 90. The second end 88 of the connecting lever arms 84 is pivotally attached to the drive block 74. The second end 82 of the drive lever arm 78 includes an arcuate shaped slot 92 formed in its edge. The arcuate shaped slot 92 cooperates with the drive pin 64 mounted on the hub member 58 to move the drive lever arm 78. The movement of the drive lever arm 78 by the drive pin 64 will be discussed in more detail later.

The mechanism for lifting the lifting plate 42 includes three spiral cams 96 that are rotatably mounted on the lower platform 18. The spiral cams are driven by a flexible drive belt 98 that extends around each spiral cam 96 and is attached at one end to a wedge shaped drive member 100 that is mounted on the hub member 58. The other end of the flexible drive belt 98 is attached to a coil spring 110, which maintains tension on the flexible drive belt 98. A guide pin 112 is mounted on the lower platform 18 substantially adjacent one of the spiral cams 96. The guide pin 112 functions to prevent the flexible drive belt 98 from becoming disengaged with the spiral cams 96 under certain conditions.

Figure 7:
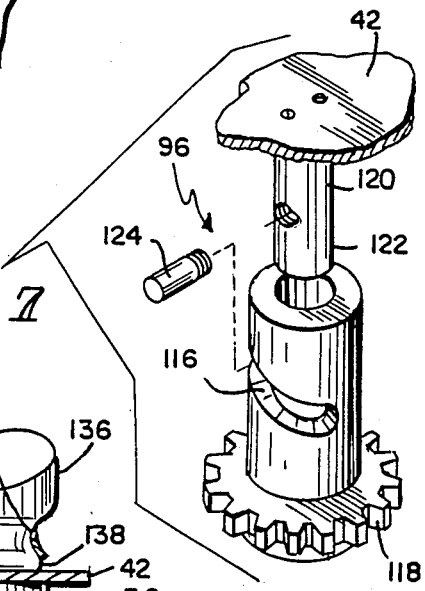
FIG. 7 is an exploded perspective view of the spiral cam and cam follower.

Referring now to FIG. 7, FIG. 7 shows the spiral cams 96 in more detail. Each spiral cam 96 includes a sprocket portion 118 that is engaged by the flexible drive belt 98 to rotate each spiral cam 96. A spiral-shaped slot 116 is formed in the body of each spiral cam 96. A cam follower unit 120 is disposed within the spiral cam 96. The cam follower unit 120 includes a follower shaft 122 that is configured to move axially within the spiral cam 96. A follower pin 124 that extends through the slot 116 is inserted into the follower shaft 122 in a conventional manner, illustratively by engaging threads formed on the follower pin 124 with threads formed in a hole formed in the follower shaft 122. The upper end of the follower shaft 122 is rigidly attached to the lower surface of the lifting plate 42. It will be understood that there are three such spiral cams 96, each with a follower shaft 122 attached to the lifting plate 42.

Figure 6:
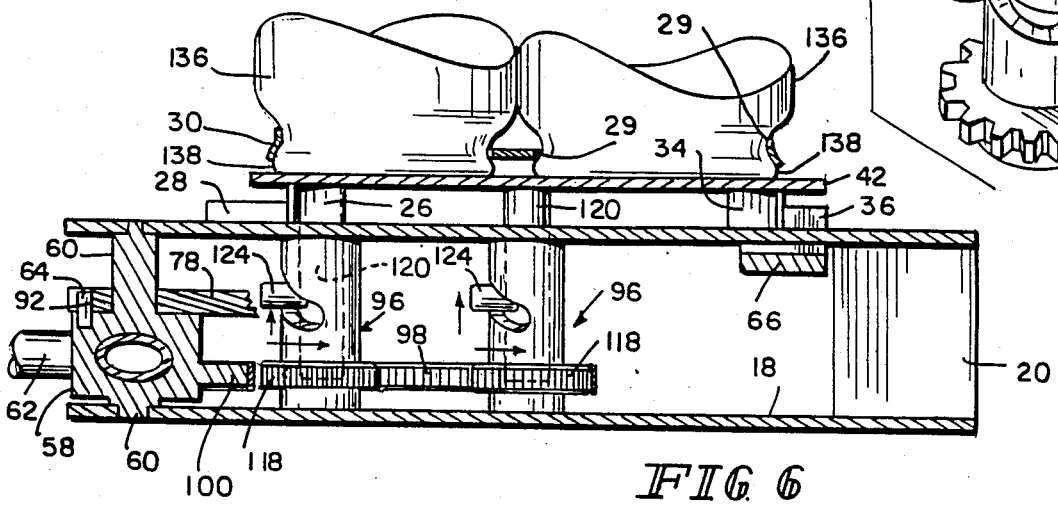
FIG. 6 is a sectional view taken along lines 6—6 of FIG. 5.

As each spiral cam 96 is rotated by the flexible drive belt 98 as indicated by arrows 126 in FIG. 5, the follower shaft 122 in each spiral cam 96 will be lifted upwardly by the combined action of the follower pin 124 and the spiral-shaped slot 116, in a conventional manner, as best shown in FIG. 6. This action will result in a lifting force being applied to the lifting plate 42 to raise the lifting plate 42 from the retracted position (FIG. 4) to the extended position (FIG. 6). The drive belt 98 is moved in the appropriate direction to rotate the spiral cams 96 in the direction of arrows 126 by moving the handle 62 clockwise as indicated by arrow 129 in FIG. 5. This movement of handle 62 moves the flexible drive belt in the direction indicated by arrow 128. Because the wedge-shaped drive member 100 has an increasing radius, the further the handle 62 is moved in a clockwise direction (arrow 129) the greater the distance the flexible drive belt 98 will be moved in a direction of arrow 128. Thus, a steady rate of movement of the handle 62 in the direction of arrow 129 will result in an increasing rate of movement of the drive belt in the direction of arrow 128. This will result in an increased rate of lifting of the lifting plate 42 as the handle 62 is moved further and further in the clockwise direction.

Figure 3:
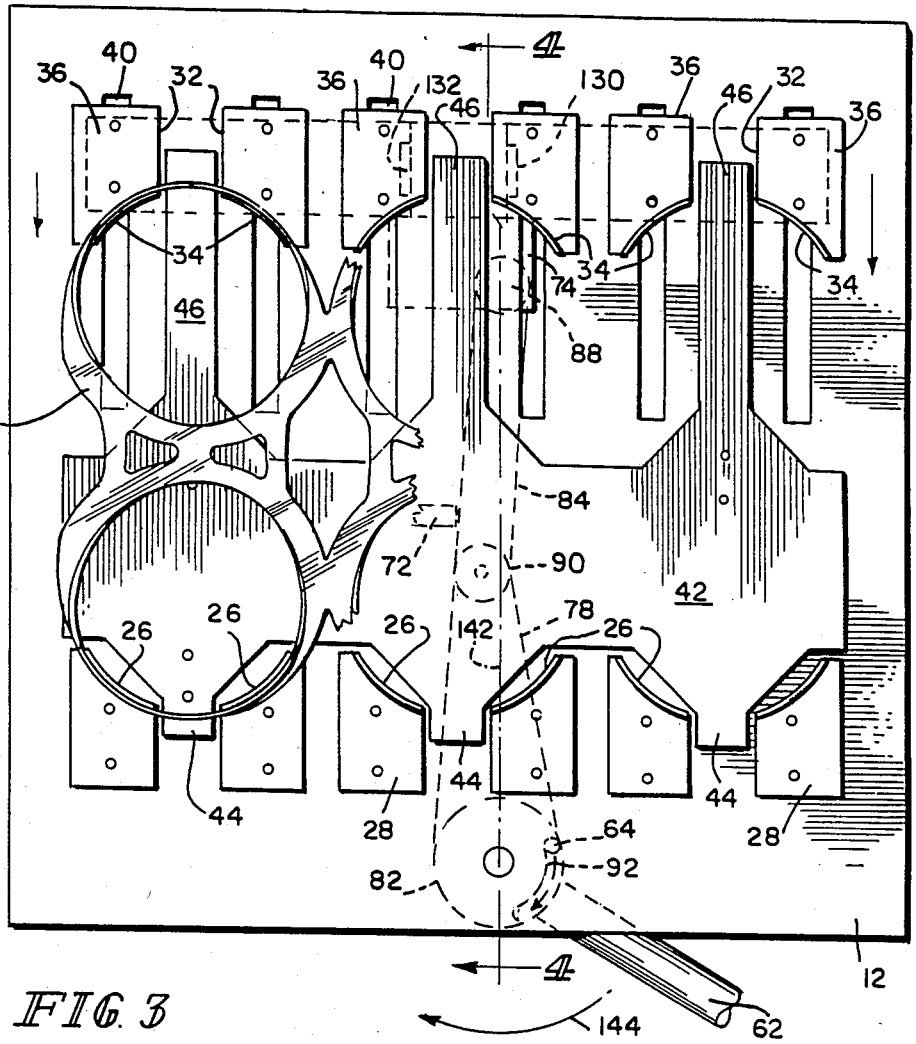
FIG. 3 is a top plan view similar to FIG. 2 with the second engaging means shown in the carrier member stretched position.

Referring now to FIGS. 2, 3, and 5, the movement of the second stretcher elements 32 by the cooperation of the drive lever arm 78, the connecting lever arms 84, and the handle 62 will be explained in detail. Initially, the transverse bar 66 and the attached second stretcher elements 32 are in the inner position with the slide block 68 in contact with the drive block 74, as shown in FIG. 2. Illustratively, an optional spring 158 may be used to yieldably interconnect the drive block 74 and the slide block 68 to aid in positioning the transverse bar 66 in the inner position. With the handle 62 in a position substantially perpendicular to the base unit 12, the drive pin 64 will be in contact with one end of the slot 92 in the second end 82 of the drive lever arm 78. As the handle 62 is moved in a counterclockwise direction, as indicated by arrow 134 (FIG. 2), the drive pin 64 will cooperate with the drive lever arm 78 to move the drive lever arm 78 and lever joint 90 in the direction of arrow 140 to move the drive block 74 away from the inner support 72 toward the outer support 71 along the slide shaft 70. Because the drive block 74 is in intimate contact with the slide block 68, the slide block 68 and attached transverse bar 66, as well as the attached second stretcher elements 32, will move in the direction toward the outer position. Continued rotation of the handle 62 in the direction of arrow 134 will move the drive lever arm 78 and connecting lever arms 84 to their full extension. At this point the slide block 68 and transverse bar 66, with attached second stretcher elements 32, will be at the outer position, furthest away from the first stretcher elements 24. Additional movement of the handle 62 in the direction of arrow 134 will result in the lever joint 90 going slightly past the center line 142 (FIG. 3) that extends between the center of the second end 82 of the drive lever arm 78 and the center of the second end 88 of the connecting lever arms 84.

Referring now to FIG. 3, this over center movement of the lever joint 90 will cause the connecting lever arms 84 to rest against the edges of the inner support 72 adjacent to base of the step portion 73. Because the lever joint 90 has moved past the center line 142 of the lever assembly, the drive lever arm 78 and connecting lever arms 84 will be locked into this extended position. Thus, the slide block 68 and attached transverse bar 66, with attached second stretcher elements 32, will become locked in the outer position.

To release the drive lever arm 78 and connecting lever arms 84 from the locked position, and thus to release the second stretcher elements 32 from the locked position, the handle 62 is first rotated freely in a clockwise direction as indicated by arrow 144 in FIG. 3. It will be understood that this action will move the drive pin 64 within the slot 92 to the opposite end of the slot 92. When the drive pin 62 reaches the opposite end of the slot 92, the handle 62 will again be substantially perpendicular to the base unit 12. Referring now to FIG. 5, continued movement of the handle 62 in the clockwise direction (arrow 129) will move the connecting lever arms 84 away from the edge of the inner support 72 to cause the lever joint 90 to move past the center line 142 (FIG. 3) of the lever assembly. Once the lever joint 90 is past the center line 142, it will be understood that the lever assembly will be unlocked, which will allow the second stretcher elements 32 to be free to move toward the inner position.

In operation, the apparatus 10 will initially be placed in a configuration as shown in FIG. 2, with the second stretcher elements 32 in the inner position. The handle 62 will be substantially perpendicular to the base unit 12, as previously described. A conventional carrier member 30, which includes six openings, each having an inner peripheral edge 29, will be placed onto the apparatus 10 so that the clips 26 of the first stretcher elements 24, and the clips 34 of the second stretcher elements 32, will engage the inner peripheral edge 29 of each opposing pair of openings. After placing the carrier member 30 onto the apparatus 10 with the clips 26, 34 inside the openings, the handle 62 is moved counterclockwise in the direction of arrow 134 to move the second stretcher elements 32, and associated clips 34, away from the first stretcher elements 24, and associated clips 26, to begin stretching the carrier member 30. When the drive lever arm 78 and connecting lever arms 84 reach the position shown in FIG. 3, the second stretcher elements 32 will be locked in the outer position. This will result in the openings in the carrier member 30 being stretched a predetermined amount. It will be appreciated by those skilled in the art that, because of the configuration of the drive lever arm 78 and connecting lever arms 84, during the constant initial movement of the handle 62 in the direction indicated by arrow 134, the drive lever arm 78 and connecting lever arms 84 will cooperate to move the second stretcher elements 32 with a higher rate of movement and a somewhat lower mechanical advantage as compared to the later stages of movement of the handle 62 as the lever assembly approaches the extended position. As the drive lever arm 78 and connecting lever arms 84 near the extended position, the mechanical advantage increases, and the rate of displacement of the second stretcher elements 34 decreases. This provides the advantage of rapidly stretching the carrier member 30 during the initial stages of the stretching operation, where the forces required to stretch the carrier member 30 are the least, and providing the greatest mechanical advantage in the final stages of the stretching operation, where the forces required to stretch the carrier member 30 are the greatest.

Figure 4:
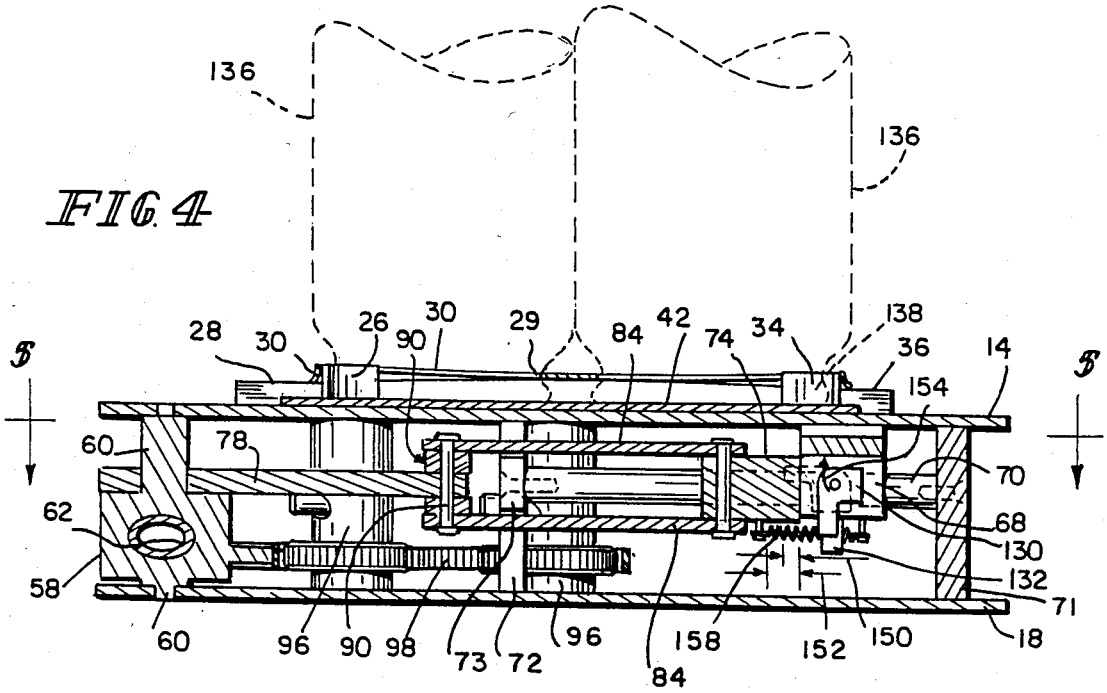
FIG. 4 is a transverse sectional view taken through lines 4—4 of FIG. 3.

After the second stretcher elements 32 are in the locked position, the carrier member 30 will be in the stretched position as best shown in FIG. 3. Individual containers 136, illustratively beverage cans, each having a lip portion 138, are then manually inserted into the stretched openings such that the inner peripheral edge 29 of each opening engages part of the lip portion 138 near the center of the carrier member 30, and the arcuate shaped clips 26, 34 engage the remaining lip portion 138 near the outer areas of the carrier member 30. This configuration of the containers 136 is best shown in FIG. 4. It will also be noted in FIG. 4 that the lifting plate 42 is in the retracted position, flush with the upper platform 14 of the apparatus 10. The ends of the containers 136 are in contact with the lifting plate 42.

Referring briefly to FIG. 5, it will be appreciated that, when the handle 62 is in the extreme counterclockwise position, the flexible drive belt 98 will have a certain degree of slack created that cannot be accommodated by the coil spring 110. This is because with the lifting plate 42 in the retracted position, as shown in FIG. 4, the spiral cams 96 are in a position where rotation in a clockwise direction (opposite the arrows 126) is no longer possible. Therefore, when the handle 62 is moved from the perpendicular position in the direction of arrow 134 (FIG. 2), the flexible drive belt 98 will be forced to create a loop 146 (shown in dotted line in FIG. 5). The guide pin 112 serves to keep the flexible drive belt 98 engaged with the adjacent spiral cam 96 while this loop 146 is formed. It will be appreciated that without the guide pin 112, the drive belt 98 could become disengaged from the spiral cams 96. Reengagement of the drive belt 98 with the spiral cams 96 in such a case might be difficult.

After the containers 136 are inserted into the stretched openings of the carrier member 30, the handle 62 is moved in a clockwise direction as indicated by arrow 129 in FIG. 5. It will be understood that movement of the handle 62 from the extreme counterclockwise position, as shown in FIG. 3, to the position where the handle 62 is substantially perpendicular to the base unit 12, will not effect the drive lever arm 78 because of the configuration of the slot 92.

When the handle 62 reaches a position substantially perpendicular to the base unit 12, the drive pin 64 will engage the opposite end of the slot 92 in the drive lever arm 78. Continued movement of the handle 62 in the clockwise direction (arrow 129) will move the first end 80 of the drive lever arm 78 and lever joint 90 in the direction indicated by arrow 148 past the center line 142 (FIG. 3) to unlock the lever assembly and second stretcher elements 32. Because the force of the stretched carrier member 30 is directed to the arcuate shaped clips 26, 34, the second stretcher elements 32 will move toward the first stretcher elements 24 somewhat to cause the openings in the carrier member 30 to tighten around a portion of the lip portion 138 of each container 136. Also, the clips 26, 34, respectively, will move into a nesting abutment with the remaining portion of the lip portion 138 of each container 136. Continued movement of the handle 62 in the direction indicated by arrow 129 in FIG. 5 will move the drive block 74 inwardly away from the slide block 68 and transverse bar 66. Thus, the transverse bar 66 and attached second stretcher elements 32 are free to slide along the slide shaft 70 because of the force of the stretched carrier member 30 toward the containers 136 to seek an equilibrium position.

Further movement of the handle 62 in a direction of arrow 129 will cause the flexible drive belt 98 to rotate the spiral cams 96 in the direction indicated by arrows 126 to begin raising the lifting plate 42 toward the extended position, away from the upper platform 14. As the lifting plate 42 is moved away from the upper platform 14, the individual containers 136 will be moved upwardly as well. Because the second stretcher elements 32 and transverse bar 66 are free to move on the slide shaft 70, upward movement of the containers 136 will be accommodated by appropriate movement of the second stretcher elements 32 and carrier member 30 to maintain the carrier element 30 and lip portion 138 of each container 136 in contact. Continued movement of the handle 62 in the direction of arrow 129 will raise the lifting plate 42 toward the full extended position as shown in FIG. 6. Such movement will disengage the portion of the inner peripheral edge 29 of the openings in the carrier member 30 from the clips 26, 34 because of the action of the first fingers 44 and second fingers 46 lifting the carrier member 30 upwardly over the clips 26, 34 to allow the entire inner peripheral edge 29 of the openings in the carrier member 30 to engage the lip portion 138 of each container 136. Thus, when the lifting plate 42 reaches the extended position (FIG. 6) the individual containers 136 will be entirely engaged by the carrier member 30. The assembled unit may then be lifted easily from the elevated lifting plate 42. The optional spring 158 will act to position the transverse bar 66 and second stretcher elements 32 in the inner position preparatory to a new carrier member 30 being put in place.

Referring now to FIG. 4, FIG. 4 shows two retractable spacers 130, 132 pivotally mounted on opposite sides of the slide block 68. Each spacer 130, 132 is individually rotatable to a position to engage the drive block 74 to increase the distance between the drive block 74 and the slide block 68. Thus, when the spacer 130 is rotated in the direction indicated by arrow 154, the space between the drive block 74 and the slide block 68 will be equal to the distance indicated by the dimension 150. Alternatively, if the spacer 132 is rotated in the direction indicated by arrow 154, the spacing between the drive block 74 and the slide block 68 will be equal to the distance indicated by the dimension 152. The spacers 130, 132 are used to increase the distance that the second stretcher elements 32 are moved away from the first stretcher elements 24 to further stretch the openings in the carrier member 30. This additional stretching of the openings in the carrier member 30 may be needed to accommodate larger sizes of containers (not shown). It will be understood by those skilled in the art that the apparatus 10, as shown with spacers 130, 132 can accommodate three different sizes of containers 136. Specifically, with the spacers 130, 132 in the storage position as shown in FIG. 4, the drive block 74 will be in intimate contact with the slide block 68 to move the second stretcher elements a first specified distance to accommodate a first size of container. If the spacer 130 is rotated in the direction of arrow 154, the slide block 68 will be spaced away from the drive block 74 a distance equal to the dimension 150. Thus, when the drive lever arm 78 and connecting lever arms 84 are moved to the full extended position, the slide block 68 and associated second stretcher elements 32 will be moved away from the first stretcher elements a second specified distance to accommodate a second, larger sized container. When the spacer 132 is rotated in the direction of arrow 154, the slide block 68 will be spaced from a drive block 74 a distance equal to the dimension 152. When the drive lever arm 78 and connecting lever arms 84 are moved to the full extended position in this case, the slide block 68 and associated second stretcher elements 32 will be moved away from the first stretcher elements 24 a third specified distance to accommodate a third, even larger sized container.

The apparatus 10 of the present invention provides a simple-to-use device that is operable with a single lever to perform the stretching operation of the carrier member 30 and the lifting operation of the assembled carrier member 30 and containers 136.

Although the invention has been described in detail with reference to a preferred embodiment and specific examples, variations and modifications exist within the scope and spirit of the invention as described and defined in the following claims.

What is claimed is:

1. An apparatus for applying a carrier member formed from a sheet of stretchable material including at least a pair of opposed openings each sized to engage the lip of a container when stretched a predetermined distance, each opening having an inner peripheral edge, the apparatus comprising:

a stationary base unit;

first means fixed to said base unit for engaging the inner peripheral edge of one of said pair of openings;

second means for engaging the inner peripheral edge of the other of said pair of openings, said second engaging means being movable with respect to said base unit from an inner position to an outer position;

means for moving said second engaging means from said inner position to said outer position to displace said second engaging means away from said first engaging means to stretch said pair of openings a distance sufficient to allow each of said pair of openings to receive the lip of a container, said movement of said second engaging means defining a working plane;

means for releasing said second engaging means from said outer position to permit each of said pair of openings to engage and capture the lip of the received container; and means for elevating the assembled carrier member and containers in a direction orthogonal to said working plane.

2. The apparatus of claim 1, wherein said moving means comprises a pair of interacting lever arms.

3. The apparatus of claim 2, wherein said pair of lever arms cooperate to lock said second engaging means in said outer position.

4. The apparatus of claim 3, wherein said moving means further comprises an enlongated handle pivotally mounted in said base unit and connected to one of said lever arms.

5. The apparatus of claim 4, wherein said elevating means comprises a movable plate and means for lifting said plate in a direction orthogonal to said working plane.

6. The apparatus of claim 5, further comprising means for driving said lifting means to raise said plate.

7. The apparatus of claim 6, wherein said lifting means comprises a spiral cam rotatably mounted on said base unit and a cam follower disposed within said spiral cam and attached to said plate.

8. The apparatus of claim 7, wherein said driving means comprises said enlongated handle and a flexible drive belt attached to said handle that engages said spiral cam.

9. An apparatus for applying a carrier member formed from a sheet of stretchable material having at least a pair of opposed openings, each having an inner peripheral edge, each opening sized to engage the lip of a can-like container, the apparatus comprising:

a stationary base unit;

a first pair of stretcher elements fixed to said base unit and configured to engage one of said pair of openings by its inner peripheral edge;

a second pair of stretcher elements slideably mounted in said base unit and configured to engage the other of said pair of openings by its inner peripheral edge, said second pair of stretcher elements being moveable in said base unit from an inner position to an outer position to stretch said pair of openings a distance sufficient to allow each of said openings to receive the lip of a container, said movement to defining a working plane;

a lifting plate mounted in said base unit between said first stretcher element and said second stretcher element and moveable from a retracted position to an extended position in a direction orthogonal to said working plane;

at least one spiral cam mounted on said base unit below said lifting plate and at least one cam follower attached to said lifting plate that cooperates with said spiral cam to raise and lower said plate;

a flexible drive belt that engages said spiral cam to drive said at least one spiral cam;

a pair of lever arms, one of said lever arms connected to said second pair of stretcher elements; and an enlongated handle pivotally mounted on said base unit and attached to the other of said pair of lever arms to move said lever arms from a position where said pair of lever arms cooperate to place said second stretcher elements in the inner position, to a position where said pair of lever arms cooperate to place and lock said second stretcher elements in the outer position, said handle configured to unlock said second stretcher elements to permit said second stretcher elements to freely move toward said inner position to permit each of said stretched pair of openings to capture said lip of said container, said handle also configured to drive said flexible drive belt to drive said at least one spiral cam to raise said plate to lift the assembled carrier and container away from said first and second pair of stretcher elements.

10. The apparatus of claim 9, wherein said pair of lever arms and said handle are configured to cooperate to provide relatively greater displacement of said second stretcher elements from said inner position toward said outer initially, and to provide relatively greater force and relatively smaller displacement as said second stretcher elements approach a position substantially near said outer position.

11. The apparatus of claim 9, further comprising a tapered wedge attached to said handle and to said flexible drive belt and configured to apply relatively greater rotatial force and relatively less rotational displacement to said at least one spiral cam initially as said lifting plate moves from said retracted position toward said extended position, and relatively less rotational force and relatively greater rotational displacement to said at least one spiral cam as said lifting plate approaches a position substantially near said extended position.

12. An apparatus for applying a carrier member formed from a sheet of stretchable material having at least a pair of opposed openings, each having an inner peripheral edge, each opening sized to engage the lip of a can-like container, the apparatus comprising:

a stationary base unit;

a first pair of stretcher elements fixed to said base unit and configured to engage the inner peripheral edge of one of said pair of openings;

a second pair of stretcher elements slideably mounted in said base unit and configured to engage the inner peripheral edge of the other of said pair of openings, said second pair of stretcher elements being moveable in said base unit from an inner position to an outer position to stretch said pair of openings a distance sufficient to allow each of said openings to receive the lip of a container;

a pair of lever arms, said lever arms having first and second ends and joined together at the first ends to form a lever joint, said second end of one of said lever arms contacting said second pair of stretcher elements; and an enlongated handle pivotally mounted on said base unit and attached to the second end of the other of said pair of lever arms to move said lever arms from a position where said pair of lever arms cooperate to place said second stretcher elements in the inner position, to a position where said pair of lever arms cooperate to place said lever joint beyond a centerline between said second ends of said lever arms to lock said second stretcher elements in the outer position, said handle configured to unlock said second stretcher elements to permit said second stretcher elements to freely move toward said inner position to permit each of said stretched pair of openings to capture said lip of said container.

13. The apparatus of claim 12, further comprising at least one shim member retractably attached to said second stretcher elements to selectively contact said second end of said one of said lever arms such that said second stretcher elements are moved to a position beyond said outer position to further stretch said openings.

* * * * *